US006368496B1

(12) United States Patent
Brown et al.

(10) Patent No.: US 6,368,496 B1
(45) Date of Patent: Apr. 9, 2002

(54) DECREASING BI-REACTIVE CONTAMINANTS

(75) Inventors: Stephen H. Brown, Princeton, NJ (US); Terry E. Helton, Glenn Mills, PA (US); Arthur P. Werner, Marlton, NJ (US)

(73) Assignee: ExxonMobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/017,777

(22) Filed: Feb. 3, 1998

(51) Int. Cl.[7] ..... C10G 29/04

(52) U.S. Cl. ..... 208/295; 208/177; 208/307; 585/323; 585/804; 585/809; 585/467

(58) Field of Search ..... 208/177, 295; 585/823, 829, 476, 809

(56) References Cited

U.S. PATENT DOCUMENTS

| | | | | | |
|---|---|---|---|---|---|
| 2,778,863 | A | | 1/1957 | Maisel et al. | 260/674 |
| 3,400,169 | A | | 9/1968 | Eng et al. | 260/674 |
| 3,835,037 | A | | 9/1974 | Fairweather et al. | 208/260 |
| 3,888,939 | A | | 6/1975 | Rosback | 260/677 |
| 4,309,281 | A | | 1/1982 | Dessau | 208/310 |
| 4,501,652 | A | | 2/1985 | Le et al. | 208/57 |
| 4,795,550 | A | | 1/1989 | Sachtler et al. | 208/307 |
| 4,954,325 | A | | 9/1990 | Rubin et al. | 423/328 |
| 4,992,606 | A | | 2/1991 | Kushnerick et al. | 585/467 |
| 5,019,670 | A | * | 5/1991 | Le et al. | 585/467 |
| 5,105,039 | A | * | 4/1992 | Pelrine | 585/407 |
| 5,132,477 | A | * | 7/1992 | Ho et al. | 585/467 |
| 5,229,341 | A | | 7/1993 | Kresge et al. | 502/64 |
| 5,236,575 | A | | 8/1993 | Bennett et al. | 208/46 |
| 5,296,428 | A | | 3/1994 | Degnan et al. | 502/84 |
| 5,330,946 | A | | 7/1994 | Hynes et al. | 502/82 |
| 5,362,697 | A | | 11/1994 | Fung et al. | 502/71 |
| 5,536,894 | A | * | 7/1996 | Degnen | 585/467 |
| 5,865,988 | A | * | 2/1999 | Collins | 585/322 |

OTHER PUBLICATIONS

L.B. Alemany and S.H. Brown, "Detailed Analysis of $C_5$ and $C_6$ Dienes In Light Process Streams. Qualitative Assessment of Cyclic vs. Acyclic Dienes in Heavier Process Streams," *Energy & Fuels*, 1995, 9:257–268.

N. Dachos et al., *Handbook of Petroleum Refining Processes*, 2nd Edition, R.A. Meyers, Ed., McGraw–Hill, New York 1997, pp. 4.3–4.26.

* cited by examiner

*Primary Examiner*—Helane E. Myers

(57) ABSTRACT

Bromine reactive hydrocarbon contaminants are removed from aromatic streams by first providing an aromatic feedstream having a negligible diene level. The feedstream is contacted with an acid active catalyst composition under conditions sufficient to remove mono-olefins. An aromatic stream may be pretreated to remove dienes by contacting the stream with clay, hydrogenation or hydrotreating catalyst under conditions sufficient to substantially remove dienes but not mono-olefins.

20 Claims, 1 Drawing Sheet

DECREASING BI-REACTIVE CONTAMINANTS

This invention relates to removing bromine reactive hydrocarbon contaminants in aromatic streams by contacting the stream with an acid active catalyst. The aromatic streams have a negligible diene level before contacting and decreased levels of mono-olefins and dienes after contacting. Dienes may be removed in a pre-treatment step according to the invention.

BACKGROUND OF THE INVENTION

In petroleum processing, aromatic streams are derived from processes such as naphtha reforming and thermal cracking (pyrolysis). These aromatic streams also contain undesirable hydrocarbon contaminants including mono-olefins, dienes, styrenes and heavy aromatic compounds such as anthracenes.

The aromatic streams are used as feedstocks in various subsequent petrochemical processes. In certain of these processes, such as para-xylene production, e.g., from an aromatic stream containing benzene, toluene and xylene (BTX) or toluene disproportionation, hydrocarbon contaminants cause undesirable side reactions. Therefore the hydrocarbon contaminants must be removed before subsequent processing of the aromatic streams.

Moreover, improved processes for aromatics production such as that described in Handbook of Petroleum Processing, McGraw-Hill, New York 1997, pp. 4.3–4.26, provide increased aromatics yield but also with an increase in bromine-reactive hydrocarbon contaminants. The shift from high-pressure semiregenerative reformers to low-pressure moving bed reformers results in a substantial increase in bromine reactive contaminants in the reformate derived streams. This in turn results in a greater need for more efficient and less expensive methods for removal of hydrocarbon contaminants from the aromatic streams.

Undesirable hydrocarbon contaminants containing olefinic bonds are quantified by the Bromine Index (BI). Undesirable olefins, including both dienes and mono-olefins, have typically been concurrently removed from aromatic streams such as BTX by contacting the aromatic stream with acid-treated clay. Other materials, e.g., zeolites, have also been used for this purpose. Clay is an amorphous naturally-occurring material, while zeolites used for this purpose generally are synthesized and are therefore more expensive. Both clay and zeolites have very limited lifetimes in aromatics treatment services. The length of service correlates with the level of bromine reactive impurities in the feedstream. BI-reactive contaminants rapidly age both clay and zeolites. Indeed, although clay is the less expensive of the two alternatives, large aromatic plants can spend more than a million dollars a year on clay. Furthermore, since zeolites are considerably more expensive than clay, their use in removing hydrocarbon contaminants can only be justified by dramatically improved stability in aromatics treatment so that their cycle length is practical.

An object of the invention is to provide a method for removing bromine-reactive hydrocarbon contaminants from aromatic streams with longer practical cycle lengths.

Another object of the invention is to remove bromine-reactive hydrocarbon contaminants from aromatic streams using crystalline molecular sieve catalysts under conditions fostering catalyst stability sufficient to provide economic incentive to replace clay for this purpose.

Yet another object of the invention is to provide a method of pretreating aromatic streams to remove dienes before removing mono-olefins.

SUMMARY OF THE INVENTION

A method for removing bromine-reactive hydrocarbon contaminants from an aromatic hydrocarbon stream comprises providing an aromatic feedstream which has a negligible diene level, and contacting the feedstream with an acid active catalyst composition under conditions sufficient to remove mono-olefinic bromine-reactive hydrocarbon contaminants.

The acid active catalyst is preferably a crystalline molecular sieve material having ten or more membered oxygen rings, more preferably a layered material.

The aromatic hydrocarbon stream to be contacted with the acid active catalyst is an essentially diene-free aromatic hydrocarbon feedstream. This feedstream may emerge diene-free from another petroleum processing procedure, or a diene-containing stream can be pre-treated to selectively remove dienes. The stream can be pre-treated by contacting with clay or a hydrotreating catalyst under conditions sufficient to substantially remove dienes but not mono-olefins.

DETAILED DESCRIPTION OF THE INVENTION

Figure 1:
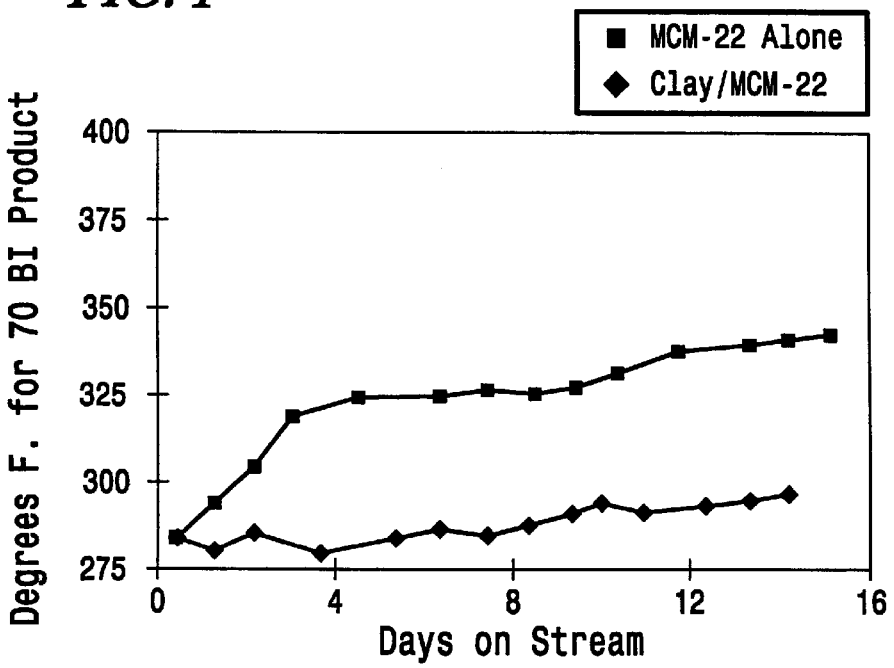
FIG. 1 is a graph illustrating the results of Example 4.

The present invention is a method for removing bromine-reactive hydrocarbon contaminants from aromatic streams.

FEEDS

Aromatic streams can be obtained from reforming and cracking processes. The streams include, e.g., mononuclear aromatic hydrocarbons and undesirable olefins including styrenes, and the streams have an initial Bromine Index (BI) from about 100 to about 3000. The Bromine Index is an indicator of the presence of olefinic bonds. Bromine Index is determined according to ASTM D 2710-92 and is a measure of milligrams of bromine consumed by 100 grams of sample under given conditions.

The aromatics include, for example, benzene, toluene, xylene, ethyl benzene, cumene and other aromatics derived, e.g., from reformate. Reformate is separated by distillation into light reformate which is mostly benzene and toluene, and heavy reformate which includes toluene, ortho-, meta- and para-xylenes and other heavier aromatics including C9+. Some aromatic streams such as heavy reformate derived from semi-regen processes contain negligible levels of dienes as they emerge from the processing. By negligible is meant that the level is below 50 ppm, essentially diene-free or too low to be quantified. Other aromatic streams such as light reformate derived from semi-regen reformers and light and heavy reformate from CCR's (continuous catalyst regeneration) processes include higher levels detectable levels of dienes, e.g., over 50 ppm, as they emerge from the processes.

The aromatic streams to be treated according to the invention contain bromine-reactive hydrocarbon compounds in levels which interfere in subsequent aromatics processing. An objectionable level of olefinic contaminants is from about 0.05 to about 1.5 weight percent or a BI from about 100 to about 3000.

Using the method of the invention, the olefinic contaminants in the aromatic streams are decreased to a level which does not interfere in subsequent aromatics processing.

PRE-TREATMENT

An aromatic hydrocarbon stream to be treated to remove mono-olefins according to the invention is essentially diene-free, i.e., has a negligible level of dienes. If the aromatic stream contains dienes above these levels, the stream can be pre-treated according to the invention to remove the dienes. Dienes are more selective for catalyst deactivating coke formation than mono-olefins. Therefore, these highly reactive diene species are substantially removed over a first catalyst.

The pre-treating step is conducted at temperatures preferably of about 50 or 100 ° F. to about 500° F., more preferably about 150° F. to about 450° F. A weight hourly space velocity (WHSV) is preferably from about 0.1 to about 10 and the pressure is preferably about 50 psig to about 500 psig. The pre-treating is carried out in the absence of added hydrogen. Preferred catalysts for the pretreatment step include acid treated clay such as bentonite or traditional base metal-containing hydrogenation or hydrotreating catalysts such as $NiMo/Al_2O_3$, $CoMo/Al_2O_3$, $Ni/Al_2O_3$ and $Ni/SiO_2$.

The pre-treated aromatic feed is then treated over a second catalyst to substantially remove the mono-olefins.

CATALYSTS

The catalysts for selectively removing mono-olefin compounds include, e.g., large pore zeolites, particularly MCM-22 type materials, mesoporous materials including those termed M41 S, SAPO's, pillared and/or layered materials.

Zeolites are divided into three major groups according to their pore/channel systems. These systems include 8-membered oxygen ring systems, 10-membered oxygen ring systems, 12-membered oxygen ring systems, and the dual pore systems including 10 and 12-membered oxygen ring openings. In general, they are referred to as small, medium or large pore size zeolites proceeding from 8 to 12 membered systems. These systems are more completely described in Atlas of Zeolite Structure Types, International Zeolite Assoc., Polycrystal Book Service, Plattsburg, 1978.

The chemical composition of zeolites can vary widely and they typically consist of $SiO_2$ in which some of the silicon atoms may be replaced by tetravalent ions such as Ti or Ge, or by trivalent ions such as Al, B, Ga, Fe, or by bivalent ions such as Be, or by other members of Group III of the Periodic table of the Elements or by a combination of the aforementioned ions. When there is substitution by bivalent or trivalent ions, cations such as Na+, $Ca^{++}$, $NH_4^+$ or H+ are present in the as-synthesized zeolite, also organic ions such as tetramethylamine ($TMA^+$), tetraethylamine ($TEA^+$) and others. The organics are typically removed by calcination prior to use of the zeolite. Ion exchange of residual cations with, for example, $NH_4^+$, is generally followed by calcination to produce the acidic zeolite.

Preferred catalysts include natural or synthetic crystalline molecular sieves, with ring structures of ten to twelve members or greater. Crystalline molecular sieves useful as catalysts include as non-limiting examples, large pore zeolites ZSM-4 (omega) (U.S. Pat. No. 3,923,639), mordenite, ZSM-18 (U.S. Pat. No. 3,950,496), ZSM-20 (U.S. Pat. No. 3,972,983), zeolite Beta (U.S. Pat. Nos. 3,308,069 and Re 28,341), Faujasite X (U.S. Pat. No. 2,882,244), Faujasite Y (U.S. Pat. No. 3,130,007), USY (U.S. Pat. Nos. 3,293,192 and 3,449,070), REY and other 15 forms of X and Y, MCM-22 (U.S. Pat. No. 4,954,325), MCM-36 (U.S. Pat No. 5,229,341), MCM-49 (U.S. Pat. No. 5,236,575), MCM-56 (U.S. Pat. No. 5,362,697) and mesoporous materials such as M41S (U.S. Pat. No. 5,102,643) and MCM-41 (U.S. Pat. No. 5,098,684). More preferred molecular sieves include 12 membered oxygen-ring structures ZSM-12, mordenite, Zeolite Beta, USY, and the mixed 10-12 membered oxygen ring structures from the MCM-22 family, layered materials and mesoporous materials. Most preferred are the MCM-22 family of molecular sieves. This family, i.e., MCM-22 type materials, includes, e.g., MCM-22, MCM-36, MCM-49 and MCM-56. The MCM-22 type materials may be considered to contain a similar common layered structure unit. The structure unit is described, e.g., in U.S. Pat. Nos. 5,371,310, 5,453,554, 5,493,065 and 5,557,024.

One measure of acid activity may be termed the Alpha Value. The Alpha Value is an approximate indication of the catalyst acid activity and it gives the relative rate constant (rate of normal hexane conversion per volume of catalyst per unit time). It is based on the activity of the highly active silica-alumina cracking catalyst taken as an Alpha of 1 (Rate Constant=0.16 $sect^{-1}$). The alpha test is described in U.S. Pat. No. 3,354,078, in the Journal of Catalysis, Vol. 4, p. 527 (1965); Vol. 6, p. 278, and Vol;. 61, p. 395 (1980), each incorporated by reference as to that description. The experimental conditions of the test used herein include a constant temperature of 538° C. and a variable flow rate as described in the Journal of Catalysis, Vol. 61, p. 395 (1980). The catalysts have an alpha value from about 100 to about 1000.

The crystalline molecular sieve may be used in bound form, i.e., composited with a matrix material, including synthetic and naturally occurring substances, e.g., clay, silica, alumina, zirconia, titania, silica-alumina and other metal oxides. Naturally-occurring clays include those of the montmorillonite and kaolin families. The matrix itself may possess catalytic properties, often of an acid nature. Other porous matrix materials include silica-magnesia, silica-zirconia, silica-thoria, silica-beryllia, silica-titania, as well as ternary compositions such as silica-alumina-thoria, silica-alumina-zirconia, silica-alumina-magnesia, and silica-alumina-zirconia. A mixture of these components can also be used. The relative proportions of crystalline molecular sieve material and matrix may vary widely from 1 to 90 weight percent, usually about 20 to about 80 weight percent. The catalyst can also be used in the absence of matrix or binder, i.e., in unbound form. The catalyst can be used in the form of an extrudate, lobed form (e.g. trilobe), or powder.

PROCESS CONDITIONS

In general, the method for the removal of mono-olefins is carried out under conditions including a moderately elevated temperature preferably ranging from about 200 or 250° F. to about 500° F., more preferably from about 250° F. to about 450° F.; a space velocity preferably ranging from about 0.1 WHSV to about 100 WHSV, more preferably from about 1 WHSV to about 30 WHSV; and a pressure ranging from about 50 psig to about 1000 psig, more preferably about 100 psig to about 500 psig.

The following non-limiting examples illustrate the invention:

Experiments were conducted in a down flow fixed-bed unit in which a 18", ½" Outer Diameter (O.D.) stainless steel reactor with ⅛" O.D. internal stainless steel thermowell is centered inside a 10", single-zone furnace. The feedstreams were a $C_7^+$ aromatic stream and sloppy-cut toluene derived from a $C_7^+$ aromatics feedstock (Beaumont). The initial Bromine Index (BI) of the feedstream was 850. Feed was introduced using two high pressure displacement pumps.

The reaction pressure was held at 200 psig using a grove loader. The product stream flowed from the grove loader into a stainless steel collection pot attached to a vent. No gases were fed or produced. The liquid product was analyzed by capillary column gas chromatography for olefin conversation and for total bromine reactives using the ASTM defined bromine index test D 2710-92.

Clay (F-24, Engelhard, Menlo Park, N.J.) was calcined at 250° C. for at least one hour to remove water before being loaded into the reactor and used for aromatics feed treatment.

EXAMPLE 1

The clay was used for aromatics feed treatment. Conditions and results are shown in Table 1 below:

TABLE 1

| | Case Results | | | | |
|---|---|---|---|---|---|
| MB | Bed Temp DEG. F. | WHSV | DOS | PDT BI | Total BI Bbl per # cat |
| 0 | 390 | 4 | | | |
| 1 | 390 | 4 | 0.67 | 20 | 201 |
| 2 | 390 | 4 | 2.67 | 20 | 801 |
| 3 | 390 | 4 | 3.67 | 20 | 1101 |
| 4 | 390 | 4 | 4.21 | 45 | 1263 |
| 5 | 390 | 4 | 5.7 | 79 | 1710 |
| 6 | 390 | 4 | 7.67 | 214 | 2301 |
| 7 | 390 | 4 | 8.675 | 328 | 2603 |
| 8 | 390 | 1.6 | 9.67 | 68 | 2722 |
| 9 | 390 | 1.6 | 10.67 | 61 | 2842 |
| BI BBL/# Removed Each Day at 1.6 WHSV = 120 | | | | | |
| Projected Clay Life at 1.6 WHSV = 24 Days | | | | | |

MB is mass balance
DOS is days on stream
PDT is product

The beginning of the run shown in Table 1 was carried out at accelerated WHSV in order to shorten the time needed. As shown in Table 1, the clay lifetime at 1.6 WHSV was determined to be 24 days and the clay capacity was 2850 BI barrels per pound of clay. This means that one pound of clay will treat 3.2 barrels of this 850 BI feedstock before reaching an end of cycle BI specification of 70.

EXAMPLE 2

In a second aging run F-24 clay was used to selectively convert dienes for 96 days at temperatures below 291° F. The test run conditions and results are reported in Table 2.

TABLE 2

| | 120-Day Clay Run | | | | |
|---|---|---|---|---|---|
| MB | Bed Temp Deg. F. | WHSV | DOS | Pdt BI | Total BI Bbl per # clay |
| 2 | 175 | 1.6 | 1.6 | 327.37 | 125 |
| 5 | 175 | 1.6 | 6.6 | 594.93 | 345 |
| 7 | 175 | 1.6 | 8.6 | 476.64 | 452 |
| 10 | 175 | 1.6 | 13.6 | 572 | 651 |
| 12 | 175 | 1.6 | 15.6 | 752 | 680 |
| 15 | 175 | 1.6 | 20.6 | 773 | 754 |
| 17 | 175 | 1.6 | 22.6 | 690 | 800 |
| 20 | 175 | 1.6 | 27.6 | 699 | 918 |
| 24 | 175 | 1.6 | 31.6 | 720 | 922 |
| 25 | 175 | 1.6 | 34.6 | 744 | 969 |
| 32 | 175 | 1.6 | 43.6 | 770 | 1123 |
| 34 | 175 | 1.6 | 45.6 | 771 | 1147 |
| 39 | 200 | 1.6 | 52.6 | 674 | 1169 |
| 40 | 200 | 1.6 | 55.6 | 610 | 1272 |

TABLE 2-continued

| | 120-Day Clay Run | | | | |
|---|---|---|---|---|---|
| MB | Bed Temp Deg. F. | WHSV | DOS | Pdt BI | Total BI Bbl per # clay |
| 45 | 200 | 1.6 | 60.6 | 710 | 1378 |
| 48 | 200 | 1.6 | 65.6 | 764 | 1476 |
| 54 | 200 | 1.6 | 73.6 | 772 | 1587 |
| 55 | 225 | 1.6 | 75.6 | 729 | 1615 |
| 56 | 250 | 1.6 | 78.6 | 626 | 1711 |
| 61 | 250 | 1.6 | 85.6 | 630 | 1922 |
| 62 | 290 | 1.6 | 88.6 | 485 | 2078 |
| 67 | 290 | 1.6 | 95.6 | 495 | 2444 |
| 70 | 390 | 1.6 | 98.6 | 29 | 2792 |
| 74 | 390 | 1.6 | 104.6 | 31 | 3485 |
| 83 | 390 | 1.6 | 117.6 | 60 | 4986 |
| 85 | 390 | 1.6 | 119.6 | 80 | 5201 |
| Clay was at 390° F. for 24 days. | | | | | |

Clay BI capacity was increased from 2850 in Example 1 to 5200 in Example 2. In both Example 1 and Example 2, the clay life at 390° F. and 1.6 WHSV was 24 days, suggesting that minimal day aging occurred at temperatures below 250° where the clay only converted about 10% of the starting feed BI. The product from MB-15 at 175° F. has a BI of 770 vs. 850 for the feed. The MB-15 product was carefully analyzed by capillary column GC and compared with the feedstock to try to identify GC peaks associated with this BI reduction. We were unable to see any significant differences between the feed and product by GC. Dienes are bromine reactive compounds that are known to exist in reformates in sufficient quantities to account for the observed BI reduction, and are present as many isomers at very low levels, which could account for the inability to observe their disappearance by GC. Another method of testing for dienes was used in Example 3 below.

EXAMPLE 3

There are no easy analytical tests for low levels of dienes in C7+ reformate. In order prove that significant quantities of dienes exist in the feed, the task of analyzing the front end of the feed was undertaken. The C7+ aromatics feed used for the clay treating was obtained by sampling the feed to a distillation column at the Beaumont refinery. A sample of the overhead from this column, a stream containing mostly toluene, was analyzed for dienes as follows: 300 gm of the sloppy-cut toluene were added to 0.50 gm of maleic anhydride in a round bottom flask. The flask was equipped with a condenser, placed in a heating mantle, and brought to reflux. After 20 hrs the flask was cooled back to room temperature. The entire contents of the flask were concentrated into a tared, 50 ml round bottom flask using a rotary evaporator equipped with a vacuum pump to hold the system at <5mm mercury. The water bath was held at 75° C. A white crystalline product (104mg) was obtained and analyzed by NMR as described by L. B. Alemany and S. H. Brown, Energy and Fuels, 1995, 9:257–268. The NMR showed the product to be largely maleic anhydride/diene adducts, and suggested about 8 diene precursors. The data show that 70% of the adducts were derived from cyclic dienes (presumably dimethyl cyclopentadienes), and 30% from acyclic dienes; 104 mg adducts corresponds to 170 ppm dienes in the starting feedstock.

The analysis of the MB-15 product showed a BI reduction of about 80. About 200 ppm of dienes in the C7+ boiling range would result in an 80 BI reduction, closely matching the 170 ppm dienes proven to be in the light end of the feed. Since we knew from the above analysis that dienes were in the feed in an amount that would account for the observed BI reduction over the clay, we looked for a convenient way to analyze the clay product for diene conversion. The NMR analysis indicated that most of the dienes were cyclic, which led us to reason that in the toluene boiling range the most prominent dienes would be dimethylcyclopentadienes. These molecules have a mass ion of 94, which is not shared by any other hydrocarbons likely to be co-boiling with toluene. The feed and MB-15 product were submitted for GC-MS analysis equipped with selective ion monitoring. The mass ion 94 response in the toluene region of the feed and product were compared. Four peaks are clearly present in the feed and absent in the product, providing further evidence that dienes are selectively converted over the F-24 clay bed at 175° F.

The analytical results prove that dienes are much more reactive than olefins over clay and that conditions can be determined which will completely convert the feed dienes while leaving the feed olefins largely unconverted.

EXAMPLE 4

Production of a diene-free feedstock to the second catalyst bed reduces the aging rate of the second bed. To prove this, a two-reactor experiment was compared to a one-reactor experiment. The first reactor of the two-reactor unit was loaded with clay and operated at 1.6 WHSV and 175° F. with the 850 BI C7+ reformate for 7 days. At the end of 7 days the reactor outlet BI was 770. Then the second reactor was streamed with self-bound MCM-22 catalyst at 10 WHSV and 290° F. Aging was monitored by daily measurements of product BI. FIG. 1 plots the aging rates for the two runs and shows that the aging rate of the two-reactor system is significantly slower than the aging rate of the one-reactor system.

EXAMPLE 5

MCM-22/alumina extrudate, self-bound MCM-22 extrudate, hydrogen form zeolite USY/alumina extrudate, 65% zeolite Beta/silica extrudate and clay (F-24, Engelhard) were tested for removal of bromine-reactive contaminants from an aromatic stream and having an initial BI of 850.

Figure 2:
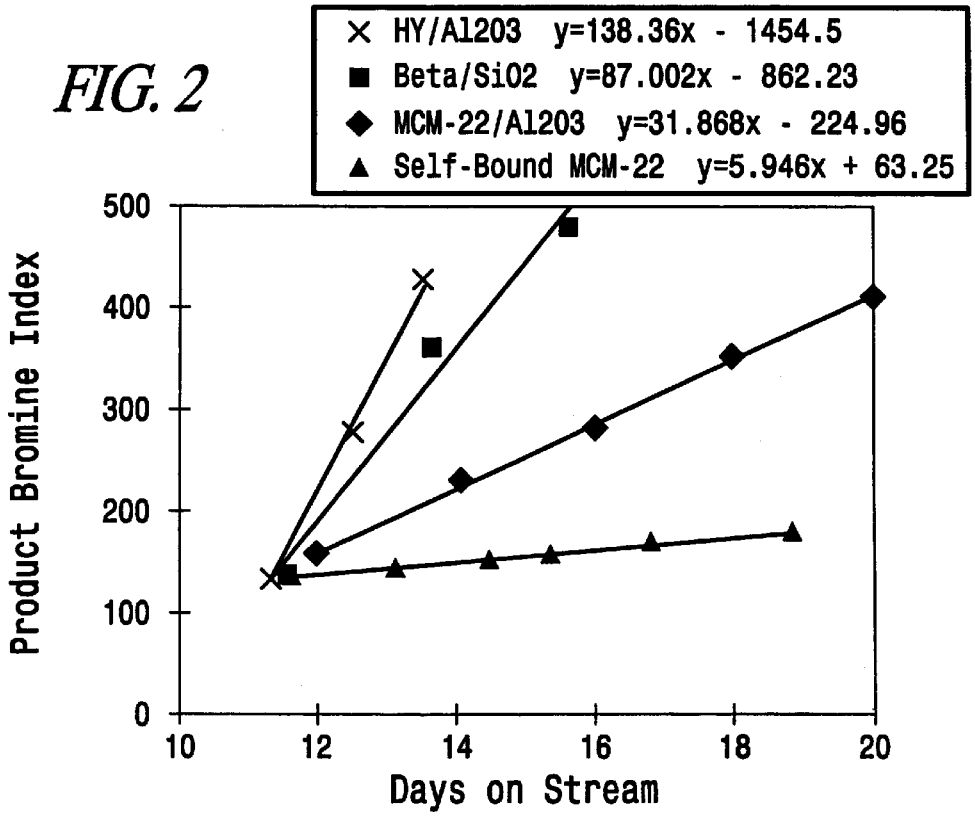
FIG. 2 is a graph illustrating the results of Example 5.

The conversion activity of bromine-reactive contaminates in the aromatic stream was measured as a function of time on stream at 10 WHSV, 390° F. and 200 psig. Catalyst Aging results are shown in FIG. 2.

The slope of the aging curve for self-bound MCM-22 is about 6.5 BI day, for MCM-22/alumina is about 30 BI/day, for zeolite beta/silica is about 90 BI/day, and for USY/alumina is about 140 BI/ day. Clay was not active at 10 WHSV.

The results show that MCM-22 is unexpectedly stable in the removal of bromine-reactive contamination from aromatic streams.

We claim:

1. A method for removing bromine-reactive contaminants from an aromatic hydrocarbon stream which comprises providing an aromatic hydrocarbon feedstream which has a negligible diene level;

contacting the feedstream with an acid active catalyst composition under conditions sufficient to remove mono-olefinic bromine-reactive contaminants.

2. The method of claim 1 wherein the diene level is below 50 ppm.

3. The method of claim 1, wherein the aromatic hydrocarbon stream comprises C7+ reformate or light reformate.

4. The method of claim 3 wherein the reformate comprises benzene, toluene and xylene.

5. The method of claim 1 wherein the acid active catalyst composition comprises a crystalline molecular sieve material with a pore/channel system having ten or more membered oxygen ring openings.

6. The method of claim 5 wherein the crystalline molecular sieve material is selected from the group consisting of materials having 10 membered oxygen ring openings, 12 membered oxygen ring openings, both 10 and 12 membered oxygen ring openings, and combinations of these materials.

7. The method of claim 5 wherein the crystalline molecular sieve material comprises a layered material.

8. The method of claim 7 wherein the crystalline molecular sieve material comprises MCM-22, MCM-36, MCM-49, or MCM-56.

9. The method of claim 5 wherein the crystalline molecular sieve material is in bound or unbound form.

10. The method of claim 9 wherein the crystalline molecular sieve material is bound with a binder matrix comprising alumina.

11. The method of claim 1 wherein the conditions comprise a temperature from about 200° F. to about 500° F., a space velocity from about 0.1 WHSV to about 100 WHSV, and a pressure from about 50 to about 1000 psig.

12. The method of claim 1 wherein the aromatic hydrocarbon feedstream has a negligible diene level as it emerges from a previous petroleum processing procedure.

13. The method of claim 1 wherein the aromatic hydrocarbon feedstream has a diene level which has been decreased by pre-treatment of the feedstream to decrease dienes to a negligible level.

14. The method of claim 13 wherein the pre-treatment comprises contacting an aromatic hydrocarbon stream containing dienes with a diene-removing catalyst composition at conditions sufficient to remove dienes to a negligible level but not mono-olefins.

15. The method of claim 14 wherein the diene-removing catalyst comprises clay or base metal-containing hydrotreating or hydrogenation catalyst.

16. The method of claim 15 wherein the diene-removing catalyst comprises $NiMo/Al_2O_3$, $CoMo/Al_2O_3$, $Ni/Al_2O_3$ or $Ni/SiO_2$.

17. The method of claim 14 wherein the conditions sufficient to sustantially remove dienes but not mono-olefins comprise a temperature from about 50° F. to about 500° F., a space velocity from about 0.1 WHSV to about 10 WHSV, and a pressure from about 50 to about 500 psig, and in the absence of added hydrogen.

18. A method for removing bromine-reactive contaminants which comprise dienes and mono-olefins from an aromatic hydrocarbon stream said method comprising:

contacting the aromatic stream with a catalyst composition comprising clay or hydro-treating catalyst, said contacting under first conditions comprising a temperature of about 100° F. to about 500° F., a WHSV from about 0.1 to about 10, and a pressure from about 50 to about 500 psig, to selectively and substantially remove dienes providing an essentially diene-free aromatic feedstream;

contacting the essentially diene-free aromatic feedstream with an acid active catalyst which comprises a crystalline molecular sieve material, said contacting under second conditions comprising a temperature from about 200° F. to about 500° F., a WHSV from about 0.1 to about 100, and a pressure from about 50 to about 1000 psig, to selectively remove mono-olefins from the aromatic feedstream.

19. The method of claim 18 wherein the crystalline molecular sieve material has a pore/channel system having ten or more membered oxygen ring openings.

20. The method of claim 18 wherein the crystalline molecular sieve material comprises layered material.

* * * * *